US006971536B2

(12) United States Patent
Chevillotte

(10) Patent No.: US 6,971,536 B2
(45) Date of Patent: Dec. 6, 2005

(54) PALLET CONTAINER

(75) Inventor: Jérome Emmanuel Chevillotte, Rouen (FR)

(73) Assignee: Royal Packaging Industries Van Leer B.V., Amstelveen (NL)

( * ) Notice: Subject to any disclaimer, the term of this patent is extended or adjusted under 35 U.S.C. 154(b) by 0 days.

(21) Appl. No.: 10/097,873

(22) Filed: Mar. 15, 2002

(65) Prior Publication Data

US 2002/0130129 A1 Sep. 19, 2002

(30) Foreign Application Priority Data

Mar. 15, 2001 (NL) ..... 1017618

(51) Int. Cl.[7] ..... B65D 6/08

(52) U.S. Cl. ..... 220/495; 220/495.05; 220/23.91; 206/386

(58) Field of Search ..... 220/495, 1.6, 23.91, 220/495.05, 495.06; 206/386; 108/55.1, 108/55.5

(56) References Cited

U.S. PATENT DOCUMENTS 5,358,137 A 10/1994 Shuert et al.
5,467,884 A * 11/1995 Schutz ..... 220/1.5

FOREIGN PATENT DOCUMENTS

| | | |
|---|---|---|
| BE | 756554 | 3/1971 |
| DE | 27 16 632 | 10/1978 |
| DE | 86 27 708 | 1/1987 |
| DE | 298 05 070 | 9/1998 |
| EP | 0 596 341 | 5/1994 |

* cited by examiner

*Primary Examiner*—Lee Young
*Assistant Examiner*—Harry Grosso
(74) *Attorney, Agent, or Firm*—Young & Thompson

(57) ABSTRACT

A pallet container includes a bottle, an enclosure for the bottle as well as a plastic pallet. The enclosure is a grid connected to a plastic pallet by having a lower horizontal circumferential rod received in a laterally opening circumferential groove in the plastic pallet. The rod can be locked through the use of a side plate.

13 Claims, 3 Drawing Sheets

PALLET CONTAINER

BACKGROUND OF THE INVENTION

The invention relates to a pallet container or intermediate bulcontainer. Such a container is for example known from EP 0596341A1. The use of pallet containers or intermediate bulk containers is rapidly increasing. Such containers are used for many purposes. An example is the food industry and other applications wherein hygienic handling ad processing are of importance.

DESCRIPTION OF THE RELATED ART

To that end it is suggested to have the base part of the pallet container, i.e. the pallet realised from plastic material. Except from being more hygienic than wood material from which ordinary pallets are made and which can attract and feed all kind of (micro-)organisms, the life expectany of plastic pallets is considerably higher. This justifies the relative higher costs over wooden pallets.

Because of the relatively high volume of plastic material necessary for producing a pallet, which is preferably through injection moulding, it is aimed to use a relatively cheap material. Preferably, recycled plastic material is used. However, the strength properties are not always identical to wood material used in conventional pallets.

Because of that it is necessary to provide reinforcements to stabilise the pallet container structure.

In DE 2 980 507 U1 it is proposed to provide a metallic reinforcement extending over the width of the pallet and being at its extremities directly connected to the enclosure of the container. In this way, the strength of the enclosure is used to stabilise the pallet proper.

However, this method of connecting is relatively complicated and can only locally provide reinforcement resulting in peak stresses in the plastic material which could result in creep.

EP0596341A discloses an intermediate bulk container having a circumferential groof with an opening in the horizontal plane, wherein the lower part of a sheet or grid is entered in the cirumferential groof in vertical direction. This results in simple mounting but in this way the sheet or grid does not support the strength of the pallet. This problem is solved by using locking tongues which are uniformally distributed along the circumference. However, this results in local high tensions on the pallet feet material.

SUMMARY OF THE INVENTION

The invention aims to propose an improved pallet container, wherein the enclosure also function to stabilise the pallet but wherein connection between enclose and pallet is optimised.

According to an aspect of the invention this is realised in a pallet container comprising a container, a grid or plate-shaped enclosure for said container, and a pallet for supporting said container, said enclosure being connected to said pallets, wherein the position of use said pallet comprises a substantially horizontal circumference groove, said enclosure comprising at its lower side a rod received in said groove, said rod being laterally introduced in said groove.

According to a further aspect of the invention a circumferential groove is provided in the plastic pallet. Depending on the presence of material, this groove can either be a continuous or a groove with interruptions. Generally, the groove will not extend near the area of the pallet wherein the discharge spout of the container has to be positioned. In this circumferential groove a rod of the enclosure is laterally received. This means that forces acting on the pallet will be uniformly distributed from the groove to the rod being positioned in the groove. Such uniform distribution of forces results in lower peak loads. This means that the strength of the pallet can be lowered so that the life expectancy of the pallet is increased, compared with prior art devices. Such forces substantially act in vertical direction. The engagement between enclosure and pallet is independent from possible inserts into the pallet to increase the strength thereof. This will promote simple connection of the enclosure relative to the pallet and provide freedom of design for the IBC producer.

As indicated the pallet comprises preferably a plastic pallet, but it should be realised that the invention can also be used with any kind of pallet known in the art.

The circumferential rod can be positioned in place by any mechanism known in the art. It is possible to preshape the enclosure before connecting to the pallet and to snap the rod into place after which it will be resiliently entered in the circumferential groove. Further fixing of the rod relative to the groove can be realised by providing barb like projections in the groove. Another possibility is to provide separate side plates which cover the open side of the groove after introduction of the rod. Such side plates are preferably connected to the pallet. For example, it is possible to have one part of such side plate engaging the pallet by a hook-like mechanism whilst the other side can be connected with a plastic pallet in any other way, for example by rivetting or screwing.

It is also possible to start from a substantially straight enclosure and after positioning the enclosure and pallet relative to each other to bend the enclosure to its final shape around the pallet having the rod at the same time received in the circumferential groove in the pallet.

BRIEF DESCRIPTION OF THE DRAWINGS

The invention will be further elucidated referring to a preferred embodiment shown in the drawings wherein.

DESCRIPTION OF THE PREFERRED EMBODIMENTS

Figure 1:
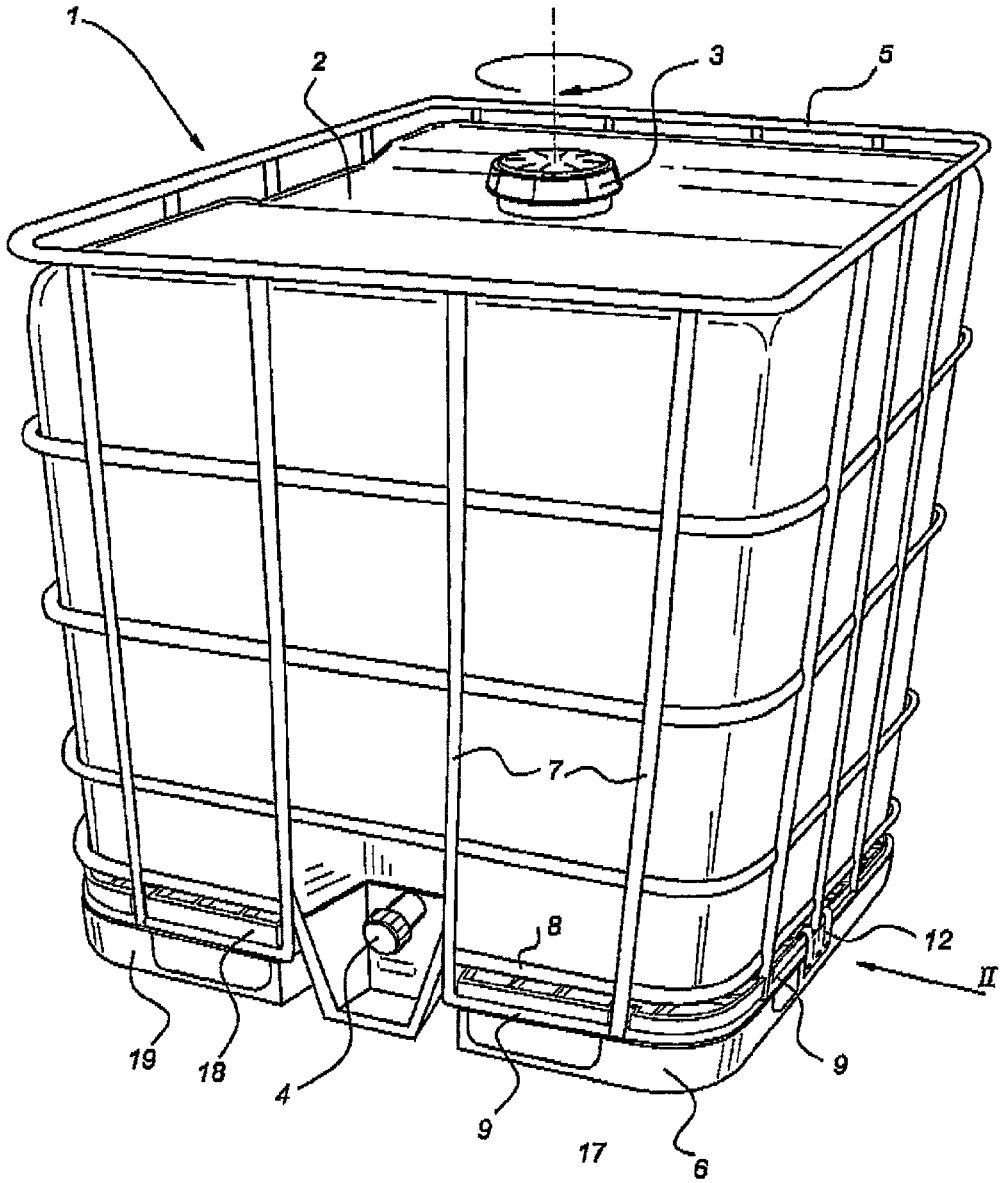
FIG. 1 schematically shows a general view of a pallet container according to the invention.

In FIG. 1 a pallet container is generally referred to by 1. It comprises a container, for example a blow moulded 1,000 litre container, having a filling opening 3 and a discharge spout 4. A discharge valve can be present but at least provision should be made that enclosure 5 of the container should not interfere the presence of such discharge valve. In this embodiment the enclosure is shown as a grid, comprising vertical rods 7 and horizontal rods 8, 9. Of course it is possible to replace the grid by a sheet structure.

The rods can be connected to each other with any method in the art such as cross-welding or by providing either one of the vertical or horizontal rods with holes to receive the other one of the vertical and horizontal rods. Each of the horizontal rods above rods 8 and 9 is made endless. The connection of the extremities of the horizontal rods can be realised by any method known in the art, such as clamping or welding. If clamping is used, one of the extremities has a smaller diameter than the opposite extremitie, so that those extremities can slide into each other, after which clamping can be realised.

Pallet 6 is according to this embodiment a plastic pallet, comprising an upper part 18 and a lower part 19 connected by support feet. At least in one direction, the centre support feed extends over the width of the pallet. In such feet extending over the width of the pallet, a cavity may be provided for receiving a metallic reinforcing profile. A plastic pallet can be produced with any method known in the art preferably by injection moulding. The material of the pallet can be any material known in the art. As example PP-EPDM recycled material is mentioned, However, LDPE material can also be used. Generally, if the pallet container according to the invention is used in the food industries, it is desirable that the pallet can withstand steam cleaning.

Figure 2:
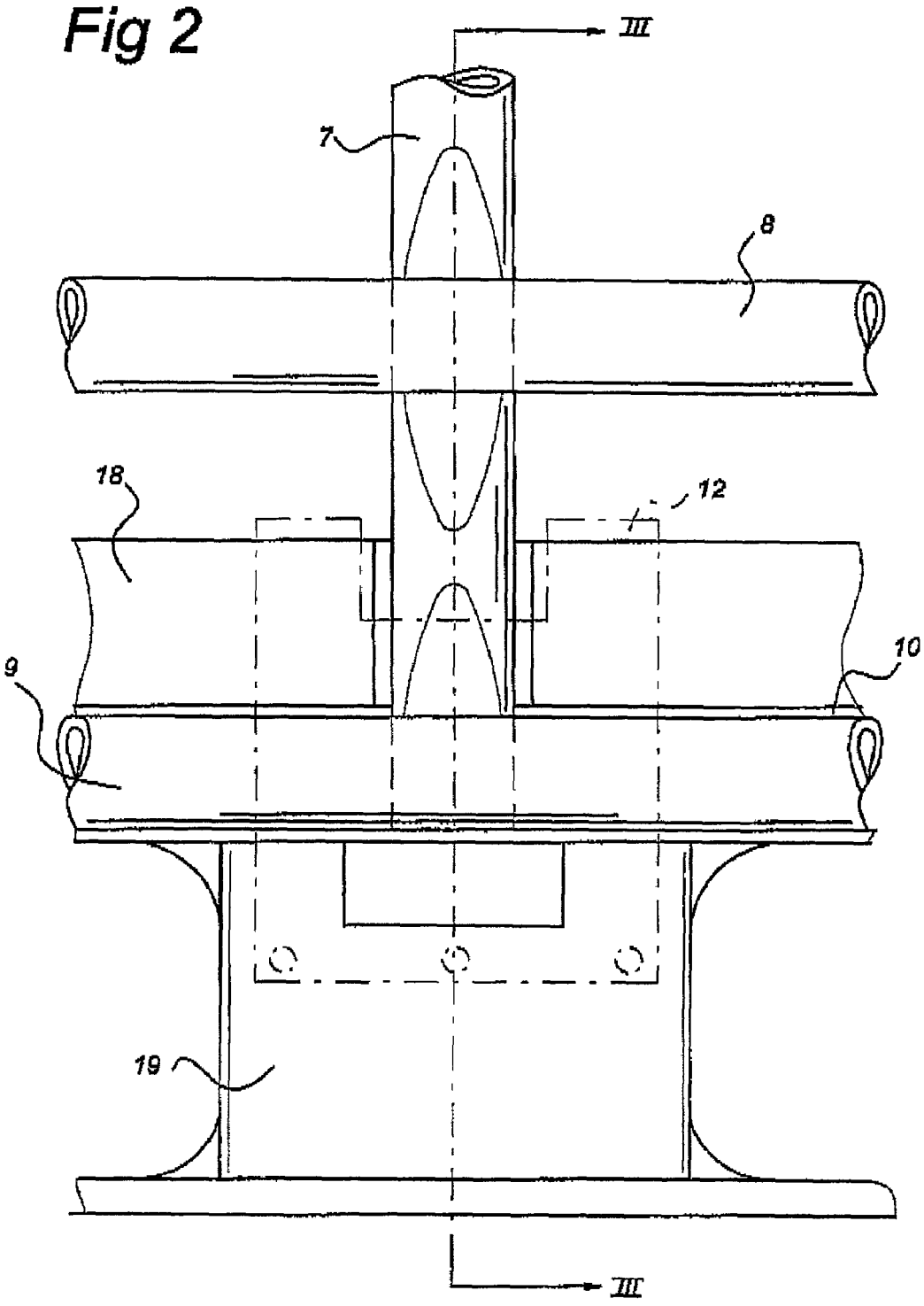
FIG. 2 shows in detail a side view according arrow II FIG. 1.
Figure 3:
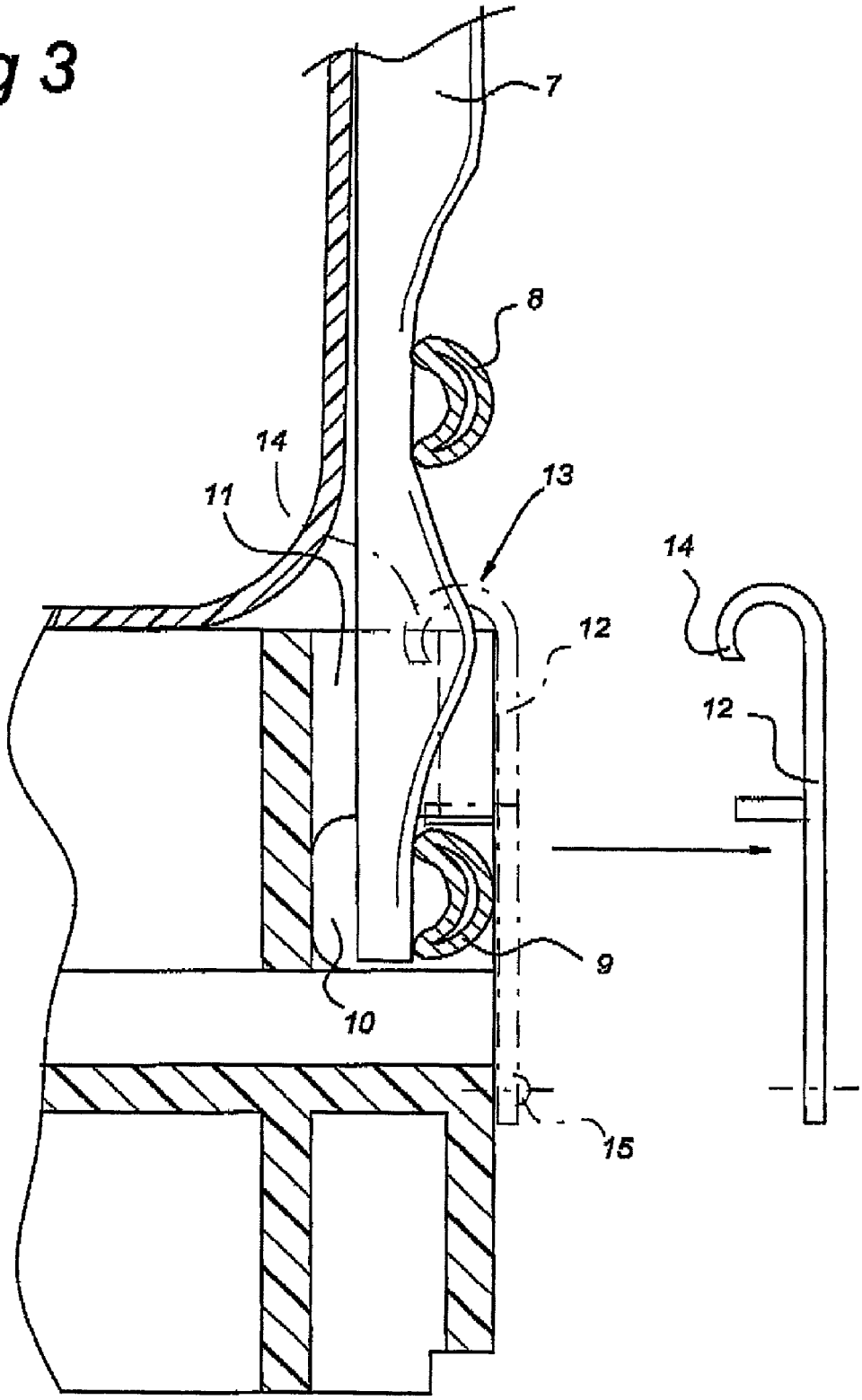
FIG. 3 shows a cross-section III—III of FIG. 2 in FIG. 1.

As is clear from the figures a circumferential groove 10 is provided substantially extending along the circumference of the pallet 6. It is shaped to receive the lower rod 9 of grid 5. This is shown in more detail in FIGS. 2 and 3. This circumferential groove 10 opens in lateral direction i.e. the lower rod is entered in horizontal direction (in the position of use of the IBC).

From these figures it is also clear that the upper part 18 of the pallet comprises an accommodation 11 for receiving the lower part of vertical rod 7, connecting rods 8 and 9. A side plate 12 is provided locking rod 9 in the correct position in recess 10. The upper part of side plate 12 has an U-shaped extremity 13 or other hook shaped, of which the flee leg 14 is received in accommodation 11 of the plastic pallet. At its lower side a rivet or screw 15 is provided to lock side plate 12 in the correct position. Such a side plate can easily be removed for removal of the grid from the plastic pallet.

Assembly of grid and pallet can basically be realised in two ways:

according to a first method, a grid structure is produced being, however, not bend to the substantially square shape as shown in the figures. This square shape is only realised after the pallet is provided, i.e. bending is realised whilst the pallet is present This means that the connection of the upper horizontal rods has to be realised with the pallet in place. Although this will set high requirements to registering, it is noted that such method is realisable in automised production. In this way optimised introduction force of rod 9 in groove 10 can be realised.

According to another possibility first of all the grid is finalised, including bending and after that lower rod 9 is snapped over plastic pallet, and more particular its upper part 18. This requires some resiliency of the grid structure. However, the lower part of the grid structure has some resiliency, because of the interruption near the discharge spout, i.e. the interruption of both rods 8 and 9.

The method of connection of the grid to the pallet is dependant from the strength of the grid material if for example a large diameter tube, such as 22 mm tube is used, relatively high forces are necessary to deform the grid structure whilst a smaller diameter tube, for example 14 mm, considerably increase the, shapability of the grid. The use of the side plates will not only localise rod 9 but also prevent sagging of the pallet.

Although the invention has been described above referring to a preferred embodiment, it will be immediately obvious for the person skilled in the art that many variants can be made without leaving the inventive though as worded in the depending claims.

What is claimed is:

1. A pallet container, comprising:

a molded container (1) with a discharge spout (4);

a pallet (6) supporting the container; and a wire grid enclosure (5) surrounding the container and attached to the pallet;

the pallet comprising a circumference horizontal groove (10), the groove facing outward from the pallet and open to an outer circumference of the pallet, the top of the pallet extending beyond the horizonal groove, the enclosure comprising horizontal rods and vertical rods, a lowermost one of the horizontal rods secured laterally in the horizontal groove, and the discharge spout being located intermediate ends of the lowermost horizontal rod.

2. The pallet container of claim 1, wherein, the pallet is plastic, the horizontal groove is a continuous horizontal groove free of interruptions, the horizontal groove has terminal ends, and the discharge spout is located intermediate the terminal ends of the horizontal groove.

3. The pallet container of claim 1, wherein, forces acting on the pallet are uniformly distributed from the horizontal groove to the lowermost horizontal rod.

4. The pallet container of claim 1, wherein, the lowermost horizontal rod is snap fit into the horizontal groove.

5. The pallet container of claim 1, further comprising:

separate vertically-positioned side plates vertically covering an open side of the horizontal groove, the side plates (12) connected to the pallet, a top part of each side plate comprising a hook engaged with the pallet and a second part of each side plate accommodating a part for mechanical connection with the pallet.

6. The pallet container of claim 5, wherein, the part for the mechanical connection is one of a rivet and a screw.

7. The pallet container of claim 1, wherein, the container has a capacity of 1,000 liters, the container further comprises a filling opening (3) on an upper horizontal surface, and one of cross-welds and holes connected the vertical rods to the horizontal rods.

8. The pallet container of claim 1, where, the pallet comprises an upper part (18), a lower part, and support feet (19) connecting the upper part to the lower part, the horizontal groove being located within the upper part and above the support feet, the pallet is molded plastic.

9. The pallet container of claim 8, wherein, the upper part of the pallet further comprises vertical grooves extending upward from the horizontal groove, plural ones of the vertical rods vertically secured within the vertical grooves.

10. The pallet container of claim 9, further comprising:

accommodations (11) within the upper part of the pallet adjacent each side of the vertical grooves; and side plates (12) with a U-shaped upper part (13) having a free leg (14) received in the accommodations of the upper part of the pallet, the side plates spanning the vertical rods where the vertical rods are secured within the vertical grooves.

11. The pallet container of claim 10, further comprising:

a mechanical connector securing a lower part of each side plate to the support feet of the pallet, the side plates being removable from the pallet.

12. A pallet container, comprising:

a plastic container (1) with a discharge spout (4);

a plastic pallet (6) supporting the container; and a wire grid enclosure (5) surrounding the container and attached to the pallet, the pallet comprising a circumference horizontal groove (10), the groove facing outward from the pallet and open to an outer surface of the pallet, an outer circumference of an upper part of the pallet defining a first circumference and an inside portion of the horizontal groove defining a second circumference, the first circumference being larger than the second circumference, the enclosure comprising horizontal rods and vertical rods, a lowermost one of the horizontal rods secured laterally in the horizontal groove, a portion of the lowermost horizontal rod being located adjacent the second circumference, the enclosure having a resilient lower portion including the lowermost horizontal rod, the lower portion being expandable to greater than the first circumference so as to fit over the outer circumference of the upper part of the pallet and thereafter flexibly snap return to the second circumference with the lowermost horizontal rod received laterally in the horizontal groove.

13. The pallet container of claim 12, wherein the horizontal rods and the vertical rods have a diameter from 14 mm to 22 mm.

* * * * *